US005297792A

United States Patent [19]

Friedman

[11] Patent Number: 5,297,792

[45] Date of Patent: Mar. 29, 1994

[54] FOOTBALL SIMULATION GAME

[75] Inventor: Ira Friedman, West Palm Beach, Fla.

[73] Assignee: Tri-Tec Industries, Boston, Mass.

[21] Appl. No.: 855,718

[22] Filed: Mar. 20, 1992

[51] Int. Cl.[5] ..... A63F 7/06

[52] U.S. Cl. ..... 273/94; 273/85 F; 273/86 F; 273/86 D

[58] Field of Search ..... 273/85 R, 85 A, 85 B, 273/85 D, 85 F, 86 E, 86 F, 86 G, 277, 441; 446/335, 352

[56] References Cited

U.S. PATENT DOCUMENTS

| | | | |
|---|---|---|---|
| 3,559,992 | 2/1971 | Kramer | 273/94 R |
| 3,782,726 | 1/1974 | Huffman et al. | 273/94 R |
| 4,150,823 | 4/1979 | Boganowski | 273/94 R |
| 4,582,323 | 4/1986 | Minkoff et al. | 273/94 R |
| 4,691,921 | 9/1987 | Iseki | 273/85 B |

*Primary Examiner*—Vincent Millin
*Assistant Examiner*—William M. Pierce
*Attorney, Agent, or Firm*—Wolf, Greenfield & Sacks

[57] ABSTRACT

A sport simulation game having a two dimensional playing field with a number of defensive players attached thereto and moveable in at least a widthwise direction. The offensive player is moveable in both a lengthwise and widthwise direction and is controlled by a hand control. The offensive player may carry a ball and the object is for the offensive player to move lengthwise over the playing field while avoiding engagement with any of the defensive players. One or two players may play the game. With two players, one player would use a hand control to control movement of the defensive player. With one player, the defensive players would be set to automatically move either independently of or dependent upon the lengthwise movement of the offensive player.

11 Claims, 15 Drawing Sheets

FOOTBALL SIMULATION GAME

FIELD OF THE INVENTION

The present invention relates to a sport simulation game and more specifically to a sport simulation game in which a person may control a player to move lengthwise and widthwise over a playing field while attempting to avoid moving obstacles.

BACKGROUND OF THE INVENTION

It has become increasingly desirable, in the field of games, to be able to simulate sports closely such that the strategies of the sport being simulated are carried over into the game and the mental skill of the human player is challenged. As such, many efforts have been directed at producing games that closely simulate team sports including football, hockey, and soccer, and individual sports such as skiing, auto racing and more.

These efforts have produced mechanical games, computer aided games, and video games. The current sophistication of electronics and computers has enabled production of computer aided and video games which simulate sports closely and require strategic adeptness for success. These games are limited, however, in that they do not offer a physical embodiment of the players or the field or surface upon which they play. Rather, these games illustrate the players and fields visually through a two dimensional video screen. This visual embodiment takes away from the overall feel of the sport being simulated. In particular, for example, a video football game does not offer the rugged, exciting feeling of the contact sport of football. While past mechanical games have offered physical replicas of the players and a physical setting of the sport being simulated, they too have limitations associated therewith. In particular, past mechanical games have limitations in the directions of movement of the physical players and do not offer multiple players whose movements are controlled independently. For example, manual mechanical soccer games include soccer players which are affixed to rotatable bars and which are movable widthwise along the playing field. As such, each soccer player on the field may only be rotated to kick the ball and moved back and forth widthwise across the field. No one soccer player can be moved lengthwise across the field while dribbling the ball to score a goal. Similarly, no past mechanical football simulation games offer a physical player who can carry the ball lengthwise across the field and dodge defensive players. As such, the true feeling of playing football and soccer are not generated by playing these past mechanical games which are absent a player or team which is moveable lengthwise across a field.

Accordingly, a general object of the present invention is to provide a sport simulation game in which a physical player may be operable and manually controllable to move lengthwise and widthwise over a playing field while avoiding obstacles on such playing field.

Another object of the present invention is to provide a sport simulation game in which obstacles or defensive players on the playing field are operable and controllable to move at least widthwise to impede movement of an offensive player.

A further object of the present invention is to provide a sport simulation game in which an offensive player is operable and controllable to move lengthwise and widthwise over a playing field and a set of defensive players automatically move back and forth widthwise across the playing field when the offensive player moves lengthwise in one direction over the playing field.

SUMMARY OF THE INVENTION

To accomplish the foregoing and other objects, features and advantages of the invention, there is provided a human controlled sport simulation game which comprises a two dimensional playing field having a length and a width. The game additionally comprises an offensive player operable and controllable to move lengthwise and widthwise over said playing field, and an array of defensive players and/or obstacles, attached to said playing field, operable to move at least widthwise, wherein a person controlling movement of the offensive player attempts to move the offensive player fully across the playing field lengthwise while avoiding engagement with any of the defensive players. The game further comprises a hand control for controlling movement of the offensive player, means responsive to the hand control, for moving the offensive player lengthwise, means responsive to the hand control, for moving the offensive player widthwise, and means for moving the array of defensive player widthwise.

In one embodiment of the present invention the means for moving the array of defensive players occurs automatically when the offensive player moves lengthwise.

In another embodiment of the present invention, the means for moving the array of defensive players is controlled independently of the movement of the offensive player, with a hand control.

In a further embodiment of the present invention the offensive player carries a ball, wherein the ball disengages from the offensive player when the offensive player engages a defensive player.

BRIEF DESCRIPTION OF THE DRAWINGS

Numerous other objects, features and advantages of the present invention will become apparent to those skilled in the art upon a reading of the following detailed description taken in conjunction with the accompanying drawings, in which.

DETAILED DESCRIPTION OF THE PREFERRED EMBODIMENT

In accordance with the present invention there is provided a sport simulation game having a two dimensional playing field with a length and a width. An offensive player is disposed over the field and is controllable to move lengthwise and widthwise. In addition, multiple obstacles are disposed on the playing field which is controllable to move at least widthwise. The object of the game is to move the offensive player lengthwise across the playing field while avoiding the moving obstacles.

Figure 1:
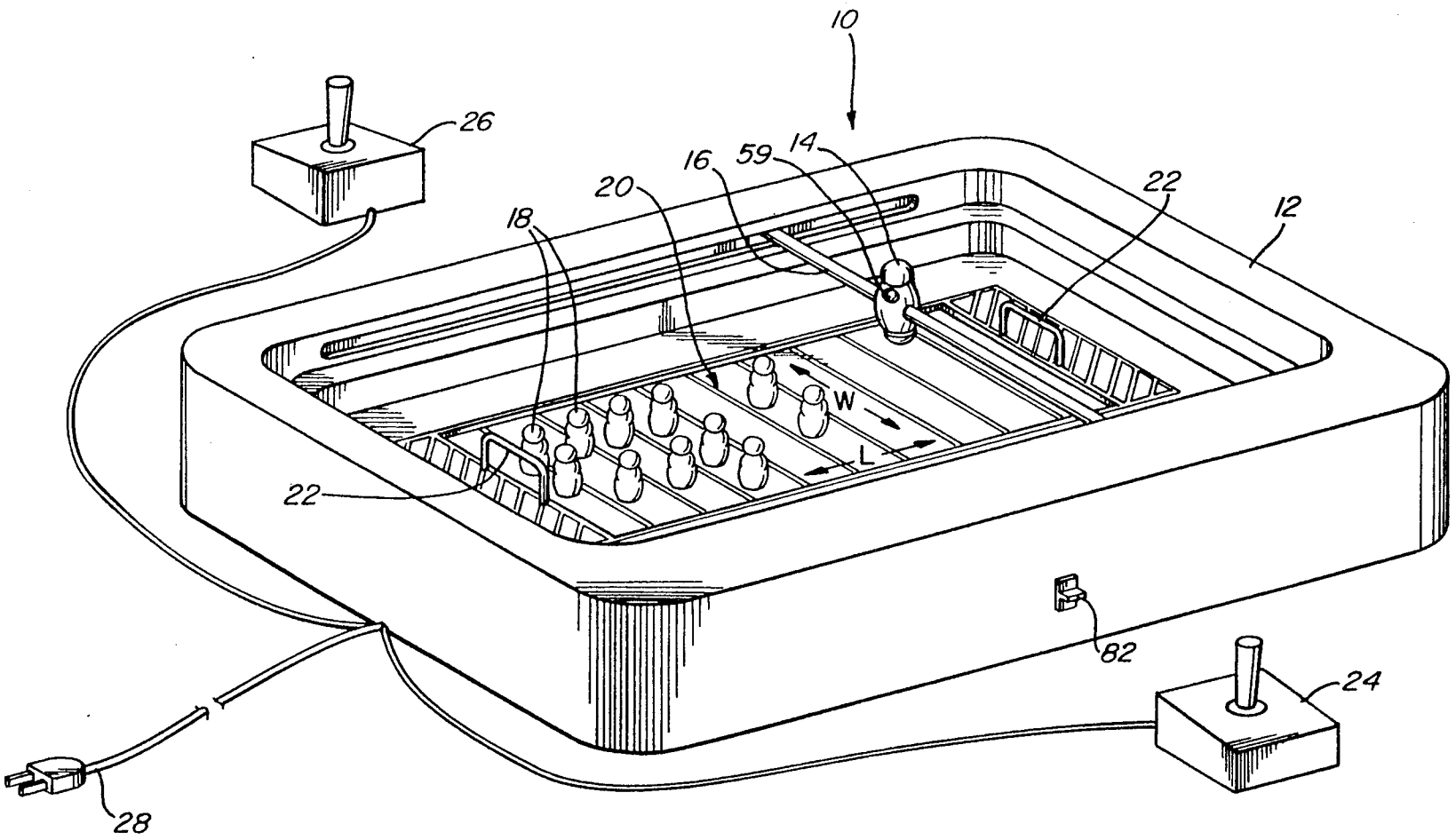
FIG. 1 is a perspective view of the sport simulation game according to the present invention.
Figure 10:
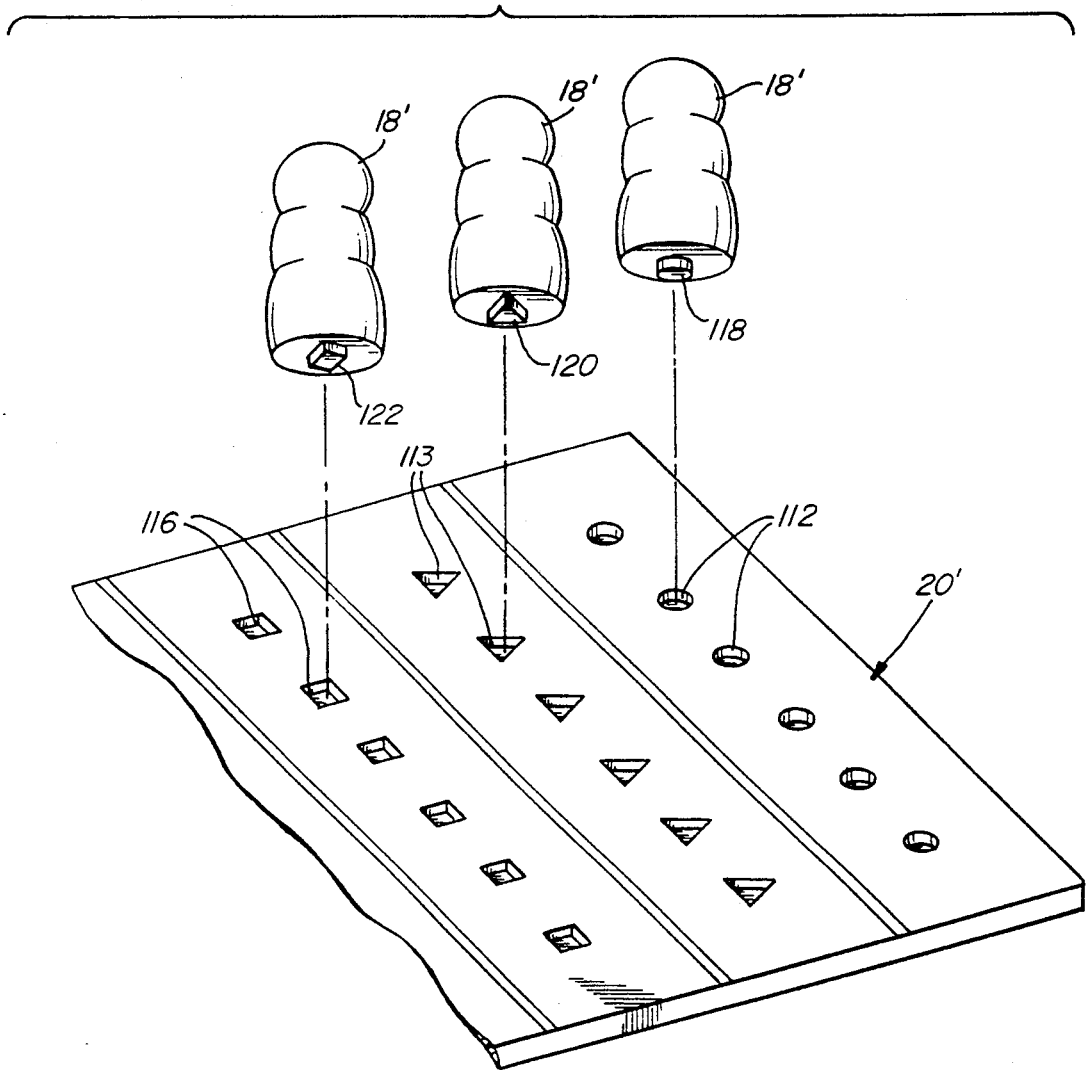
FIG. 10 illustrates an alternate embodiment of the playing field according to the present invention.
Figure 11:
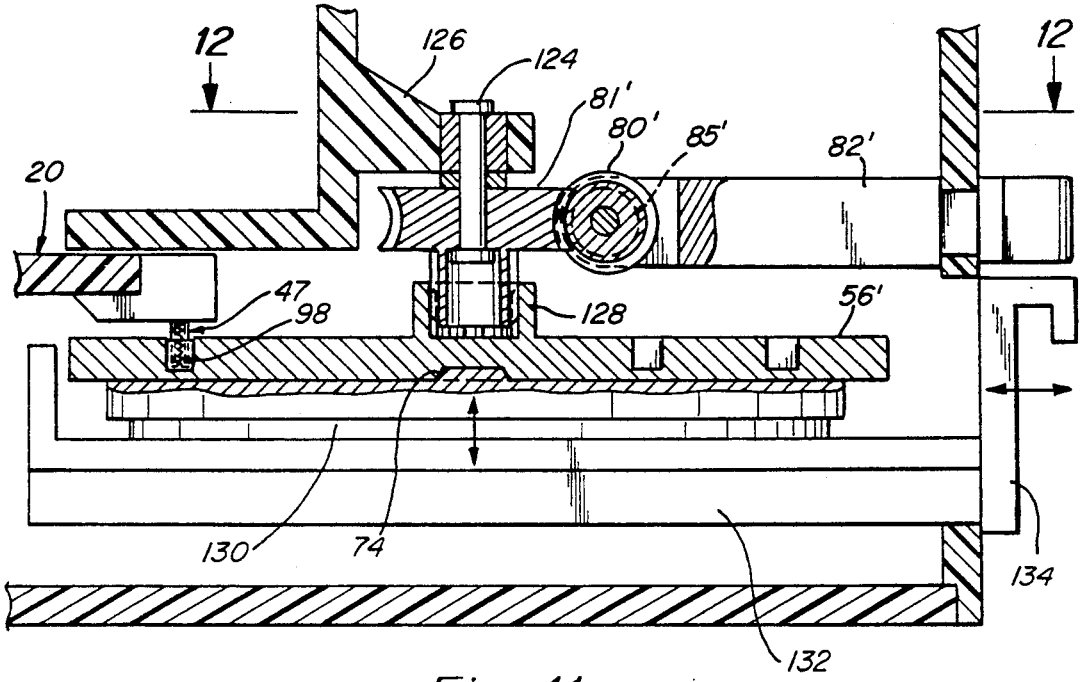
FIG. 11 is a cross sectional side view of the cam drive mechanism according to an alternate embodiment of the present invention.
Figure 12:
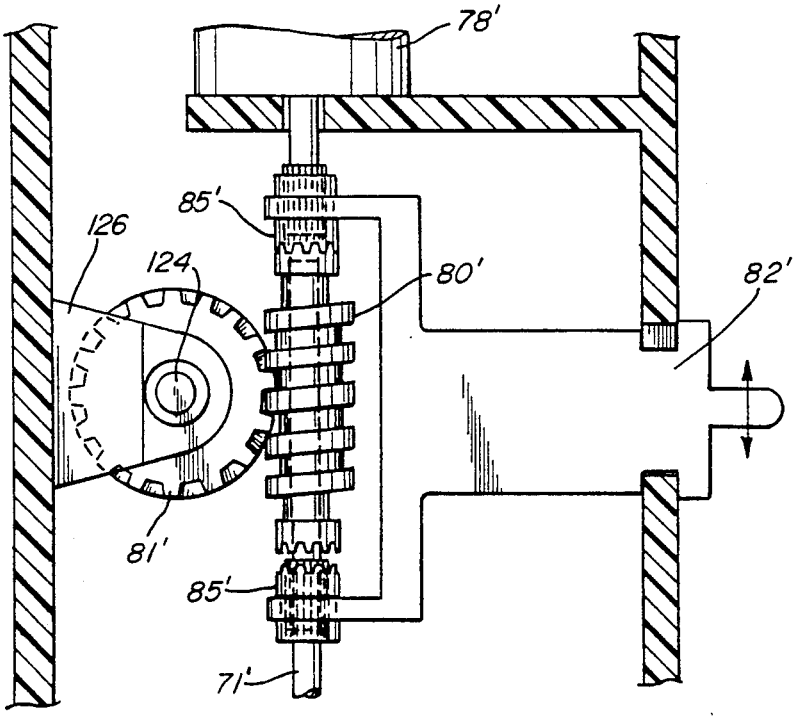
FIG. 12 is a cross-sectional plan view of the cam drive mechanism according to an alternate embodiment of the present invention, taken along line 12—12 of FIG. 11.
Figure 13:
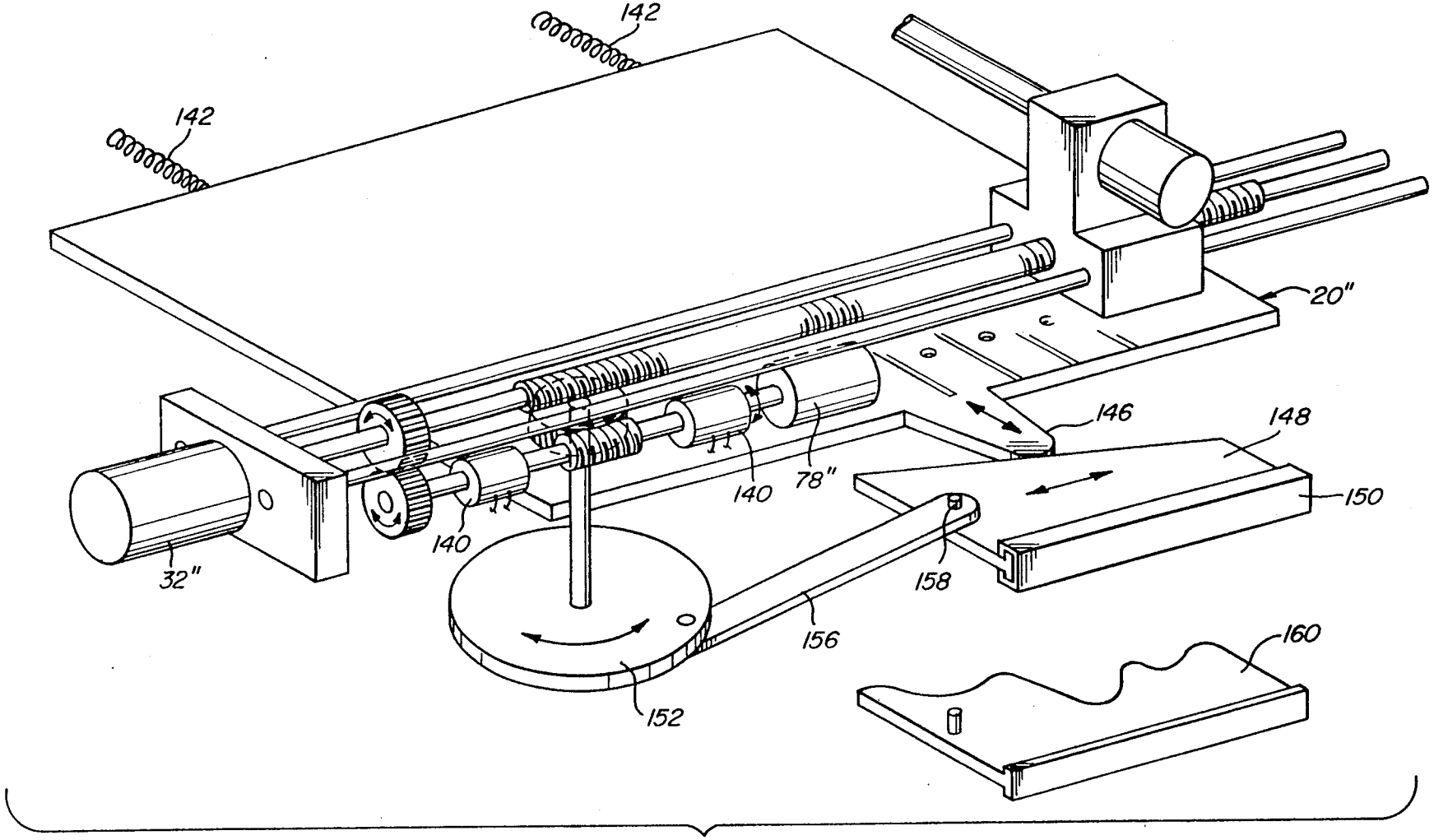
FIG. 13 is a diagramatic perspective view, illustrating the internal drive mechanisms according to an alternate embodiment of the present invention.
Figure 14:
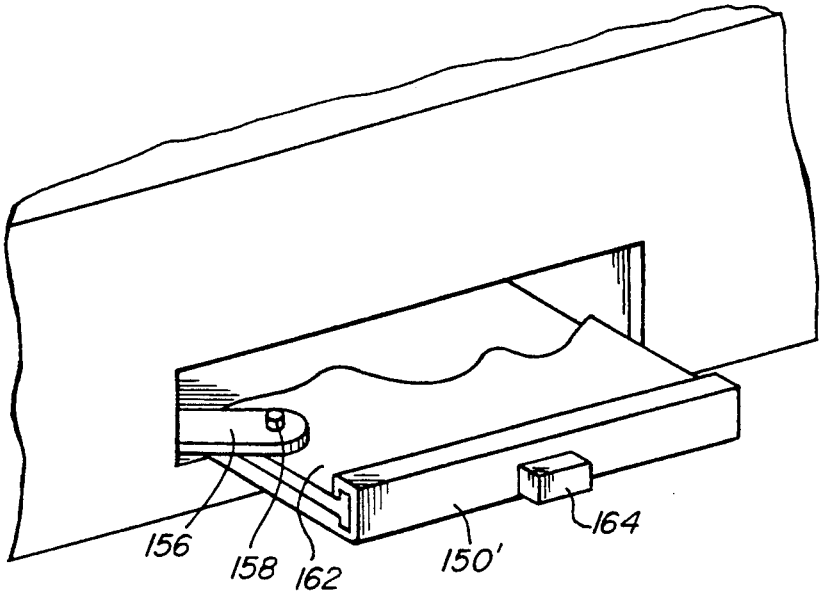
FIG. 14 is a perspective view of a changeable cam drawer according to an alternate embodiment of the present invention.
Figure 15:
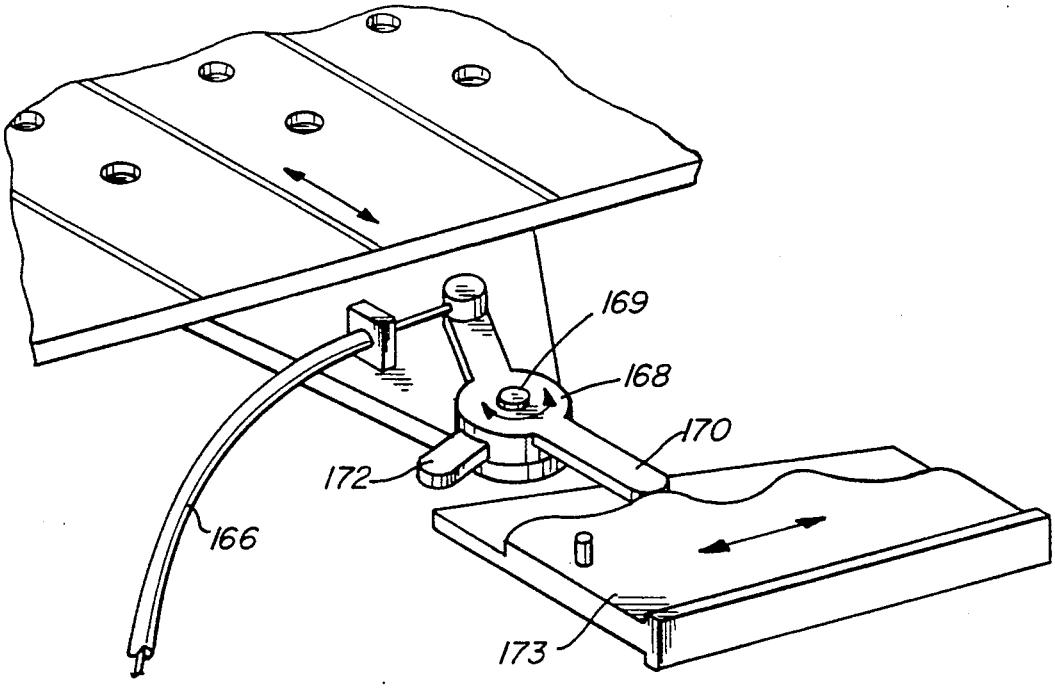
FIG. 15 is an internal perspective view of a cam follower, according to an alternate embodiment of the present invention.
Figure 16:
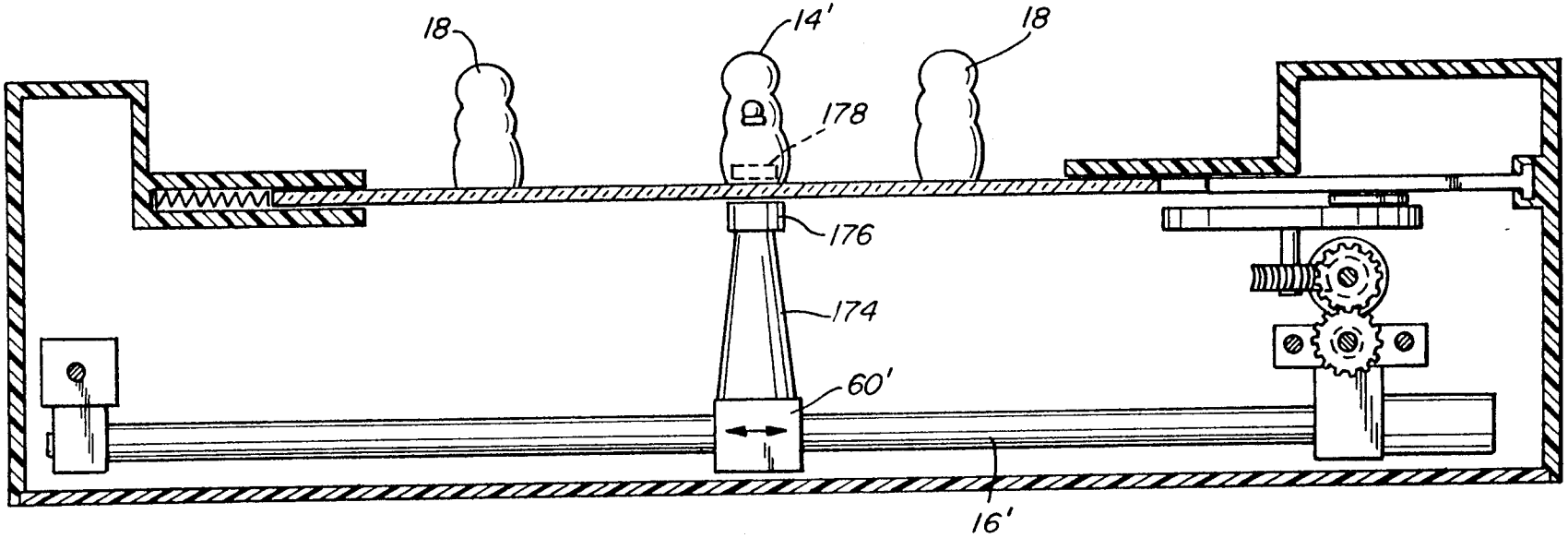
FIG. 16 is a cross-sectional end view of the internal drive mechanisms according to an alternate embodiment of the present invention.
Figure 16B:
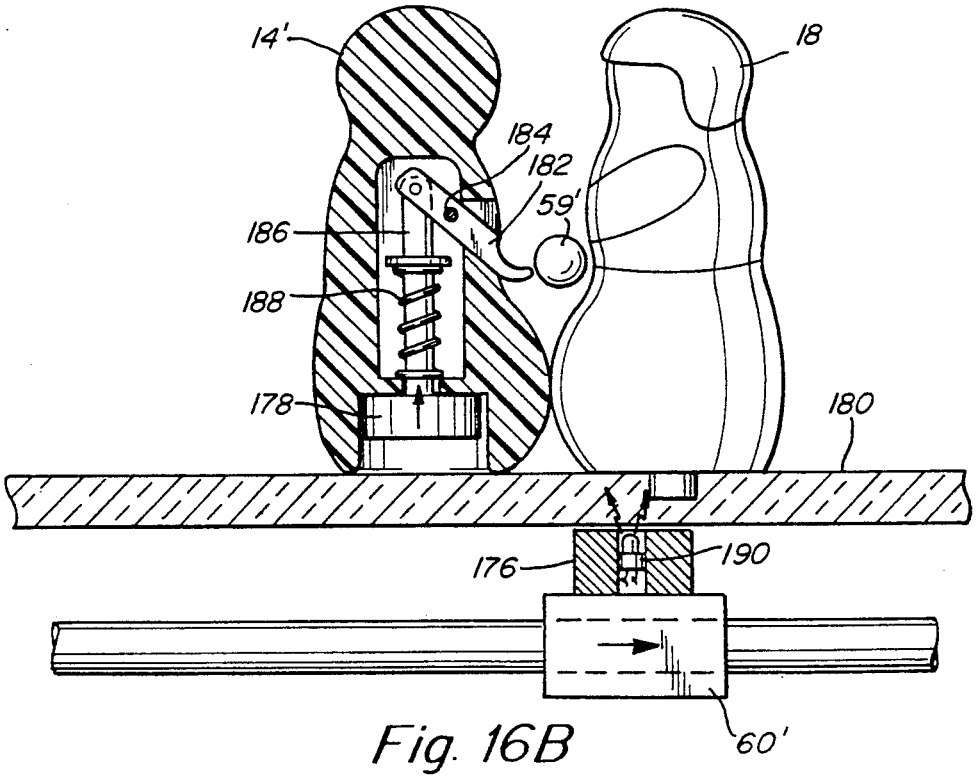
FIG. 16B is a cross sectional side view of the offensive and defensive players according to an alternate embodiment of the present invention, when the players engage one another.
Figure 17:
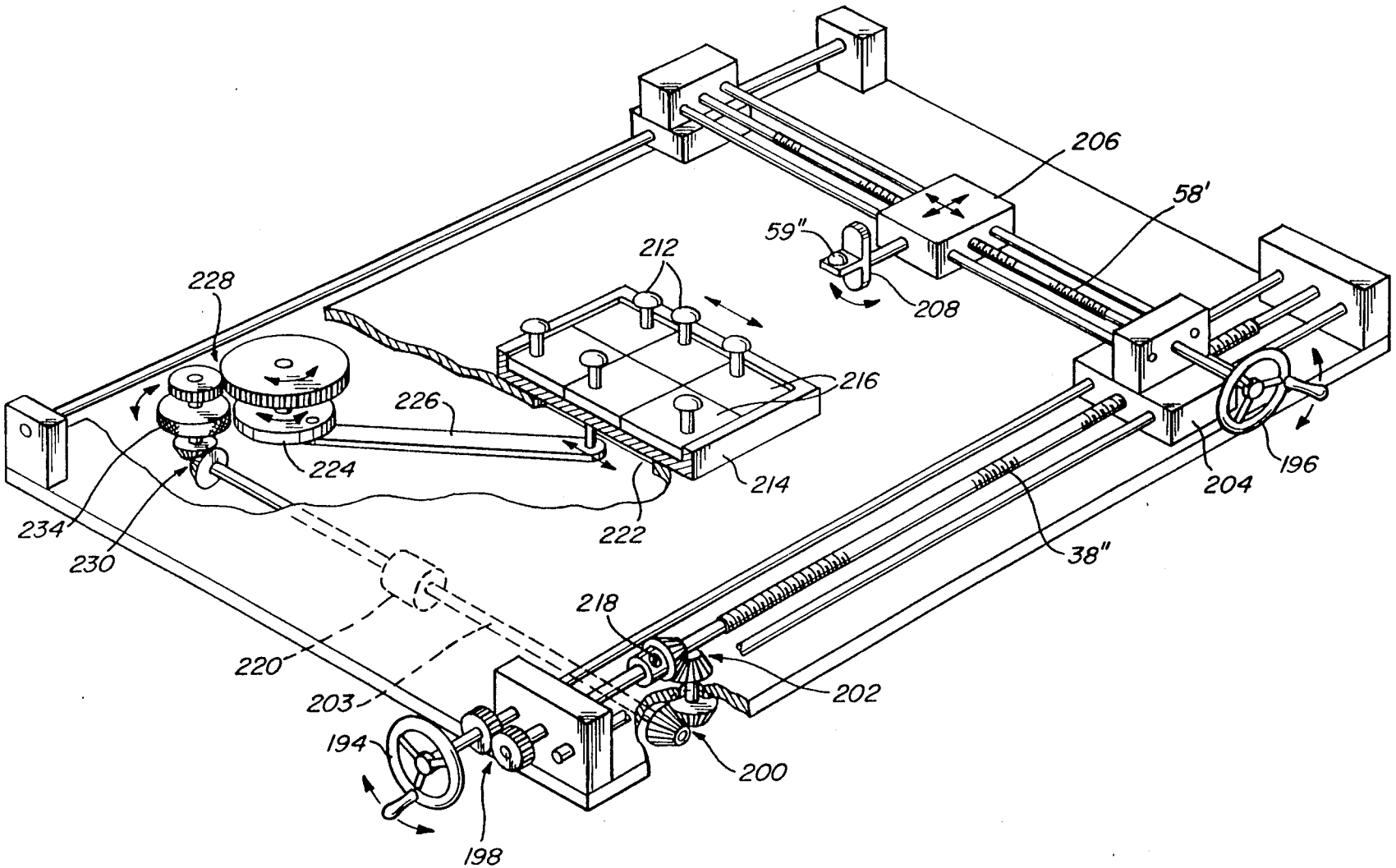
FIG. 17 is a diagramatic perspective view illustrating the internal drive mechanisms according to an alternate embodiment of the present invention.
Figure 18:
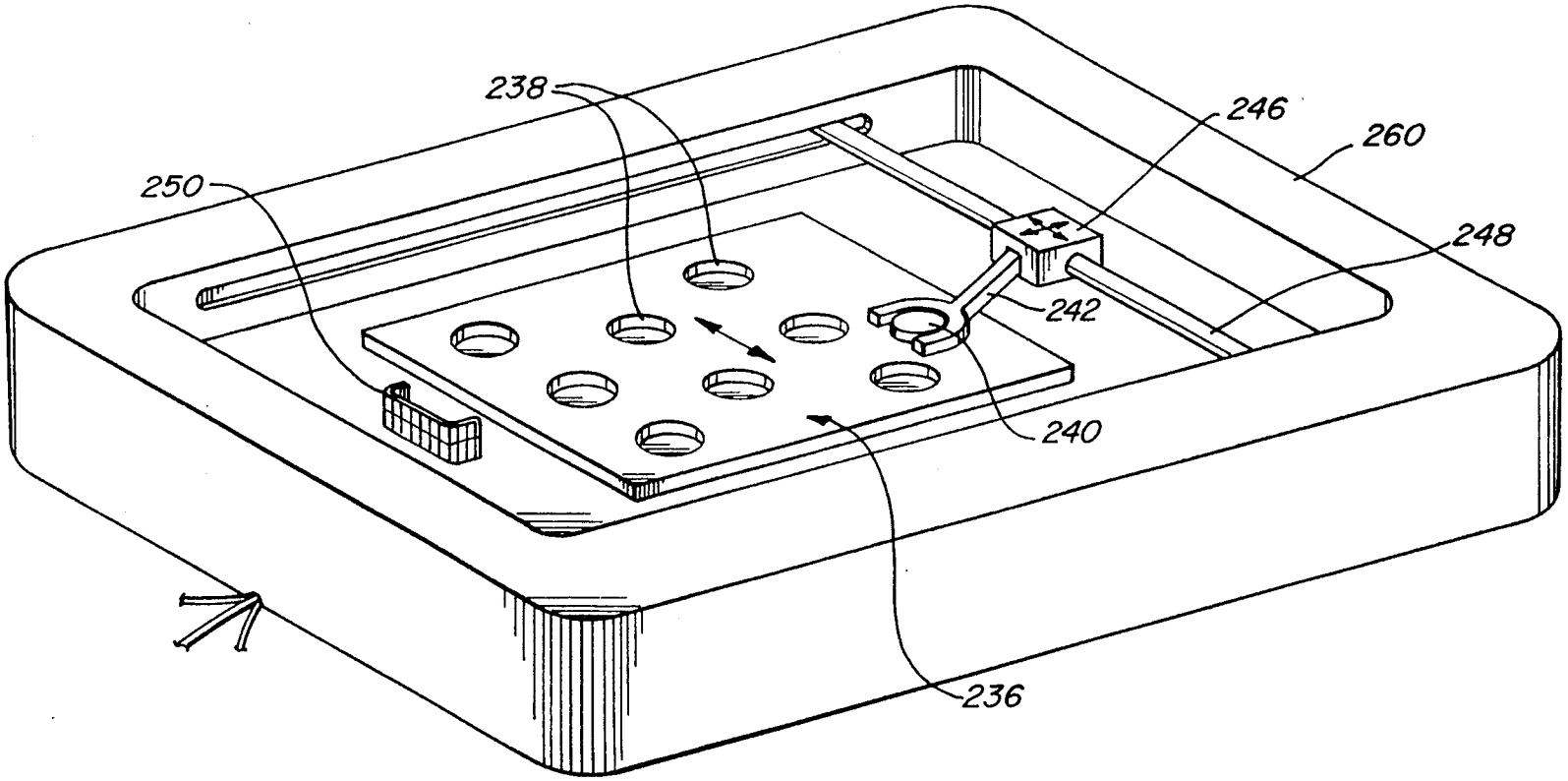
FIG. 18 is a diagramatic perspective view, illustrating the playing field according to an alternate embodiment of the present invention.

Reference is now made to the drawings and in particular to a first embodiment of the invention illustrated in FIG. 1. Further details of the mechanics of this embodiment are illustrated in FIGS. 2-9. An alternate embodiment of the playing field is illustrated in FIG. 10. An alternate embodiment mechanism is illustrated in FIGS. 11 and 12. A further alternate embodiment mechanism is illustrated in FIGS. 13-15. A further alternate embodiment mechanism is illustrated in FIGS. 16-16B. Another alternate embodiment of the present invention is illustrated in FIG. 17. An even further alternate embodiment of the present invention is illustrated in FIG. 18.

Referring to FIG. 1, simulation game 10 is illustrated with housing 12, AC outlet cord 28, which is adapted to be plugged into an AC wall outlet, and hand controls 24 and 26. Simulation game 10 includes playing field 20 with defensive players 18, affixed thereto. As illustrated, playing field 20 has a length L and a width W. Also shown is offensive player 14 affixed to tube 16 which extends widthwise over playing field 20. The game illustrated in FIG. 1 is a simulation of a football game with offensive player 14 and defensive players 18. As illustrated, offensive player 14 carries ball 59.

The object of the game is to have offensive player 14 move lengthwise across playing field 20, while dodging defensive players 18, to reach one of the goals 22. Reaching one of the goals would constitute a touchdown. It is to be appreciated that with the use of offensive hand control 24, offensive player 14 may move widthwise and lengthwise over the playing field. With defensive hand control 26 the defensive players 18 may move at least widthwise, back and forth, as a unit along with the playing field 20. Game 10 is designed for one or two players. With two players, one player would control the offensive player 14 and another player would control the defensive players 18. With one player, one person would control offensive player 14 and the defensive players would automatically move back and forth widthwise with the forward lengthwise movement of offensive player 14. When any one of the defensive players 18 contacts offensive player 14, ball 59 would come loose and the play would end.

Figure 2:
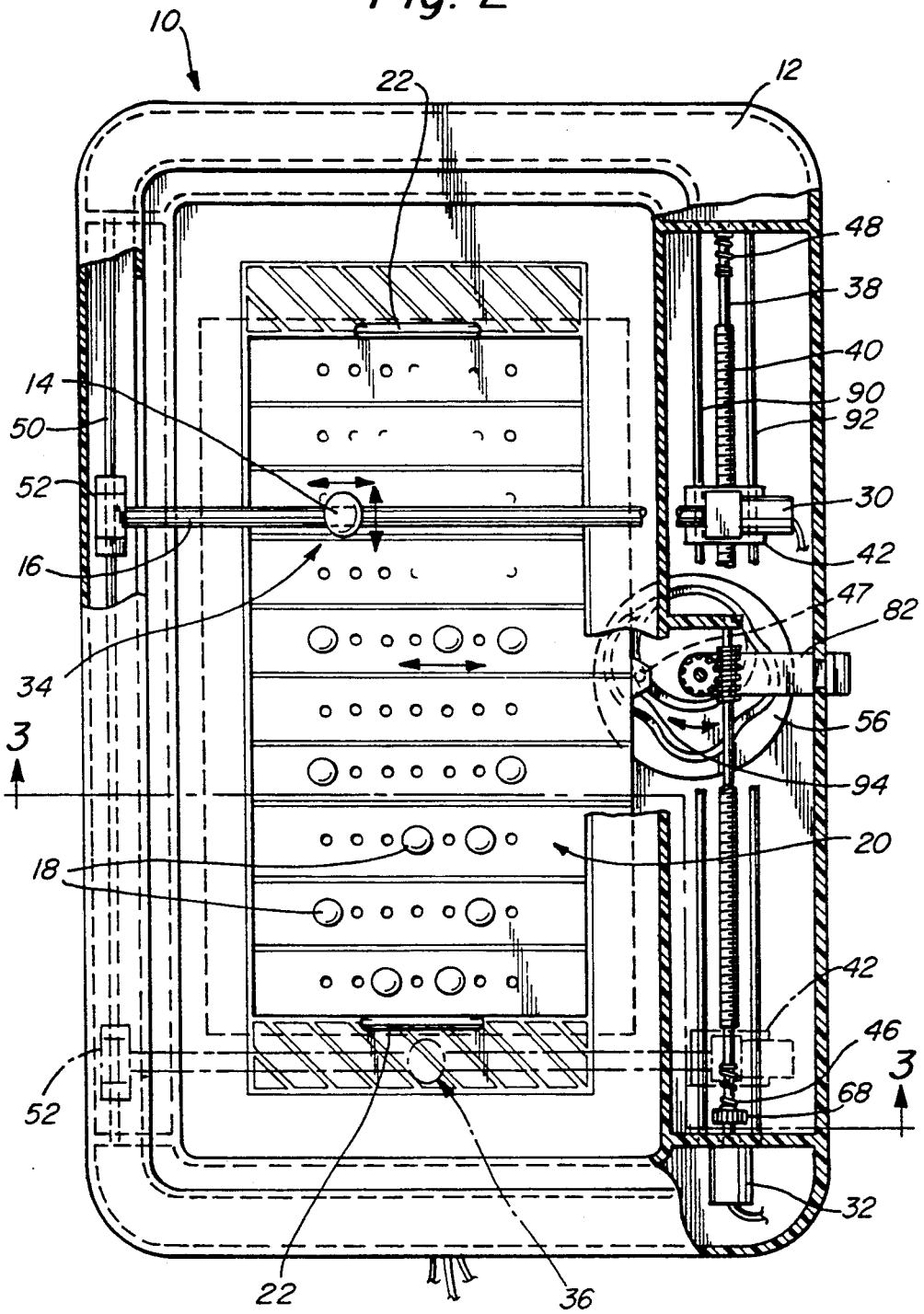
FIG. 2 is a top plan view, partially broken down view of the sport simulation game according to the present invention.

Referring now to FIG. 2, a top plan view, partially broken away of the game 10 is illustrated. Offensive player 14 is shown on tube 16 in the start run position 34. As shown, tube 16 has a member attached thereto on either side. One member 42 is also attached to lengthwise extending rod 38. The other member 52 is attached to lengthwise extending rod 50. It is to be appreciated that the whole tube 16 moves lengthwise over the field while guided by rods 38 and 50. The lengthwise movement of tube 16 provides for the lengthwise movement of offensive player 14.

Rod 38 includes threads 40 thereon and member 42 includes a thread follower for engaging the threads 40. Motor 32 is used to rotate rod 38 in both directions. With the rotation of rod 38, member 42, with the thread follower therein, moves lengthwise long rod 38 which causes the lengthwise movement of tube 16. Motor 32 is controlled by the offensive hand control. It is to be appreciated that the motor 32 can rotate rod 38 in both directions such that the offensive player can move lengthwise in both directions across the field. Rod 38 includes springs 46 and 48 at either end thereof. These springs are used to engage member 42 and halt the lengthwise movement of tube 16 at both ends of the field when the follower runs off the end of the threaded portion of rod 38. The springs also provide a bias to push the thread follower back onto the threads when the direction of rod 38 is reversed. At the bottom side of FIG. 2, in dashed lines, offensive player 14 and tube 16 are illustrated in the phantom touchdown position 36. As illustrated, member 42 (in dashed line representation) is pressed up against spring 46 for preventing any more lengthwise movement of the offensive player.

For widthwise movement of offensive player 14, tube 16 encloses a threaded member which is rotatable by motor 30, which is also controlled by the offensive hand control. Offensive player 14 is attached to a thread follower which engages the threads within tube 16. Upon rotation of the threads within tube 16, offensive player 14 can be moved back and forth widthwise across the playing field.

For widthwise movement of playing field 20, and therefore defensive players 18, cam 56 is illustrated which rotates clockwise or counterclockwise and includes a cam follower 47 which is attached to playing field 20. The cam follower 47 rests within one of the grooves of the cam 56 and moves back and forth widthwise during rotation of cam 56, as will be described in greater detail hereinafter. A shifting fork 82 is provided to shift between manual control of the widthwise movement of the defensive players and automatic widthwise movement of the defensive players 18, as will be described in greater detail hereinafter.

Figure 3:
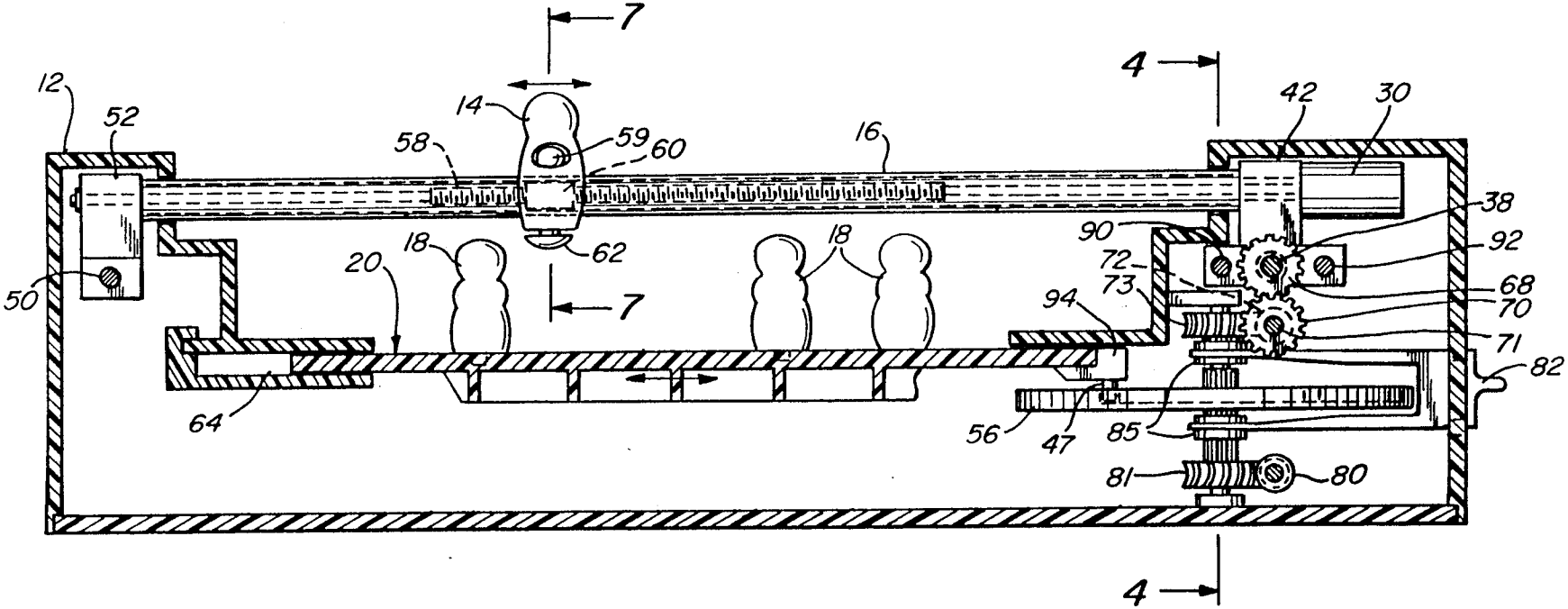
FIG. 3 is a cross-sectional end view of the sport simulation game according to the present invention, taken along line 3—3 of FIG. 2.

Referring now to FIG. 3, this cross sectional view illustrates the widthwise movement of offensive player 14 and playing field 20 with defensive players 18. Motor 30 is operable to rotate threaded member 58 within tube 16. Offensive player 14 is attached to thread follower 60 which engages threaded member 58. When threaded member 58 is rotated, thread follower 60 moves widthwise. This widthwise movement of thread follower 60 causes offensive player 14, which is attached thereto, to also move widthwise. Offensive player 14 includes downwardly depending members 62 which, when in contact with a defensive member 18, causes ball 59 to be knocked loose from offensive player 14.

Playing field 20 is movable widthwise with one end moving in and out of guide 64. The defensive players 18 have pegs thereon which rest within apertures in playing field 20. As cam 56 is rotated, and cam follower 47 rests within one of the grooves of cam 56, playing field 20 is moved widthwise, in both directions. It is to be appreciated that cam 56 may be rotated automatically with the lengthwise movement of offensive player 14, or independently controlled by the defensive hand control. Shifting fork 82 provides for a manual shifting between automatic movement of playing field 20 and manual control of the movement of playing field 20.

When manually controlled, worm drive motor 78 provides rotation for worm drive 80 which engages worm gear 81. Therefore, worm gears 81 rotates which is operably connected to cam 56, causing cam 56 to rotate.

When playing field 20 is set to automatically move, circular gears 68 and 70 cause the rotation of cam 56. Circular gear 68 is fixed on lengthwise rod 38 which rotates with the lengthwise movement of offensive player 14. With the rotation of circular gear 68, circular gear 70, which engages circular gear 68, also rotates. The rotation of circular gear 70 then rotates worm drive 72 which is attached to circular gear 70 by a shaft 71. The rotation of gear 72 causes the rotation of worm gear 73 which is connected to and cause the rotation of cam 56. It is to be appreciated that shifting fork 82 can move up and down to select between automatic movement of cam 56 with lengthwise movement of offensive player 14, and manual control of cam 56.

Figure 4:
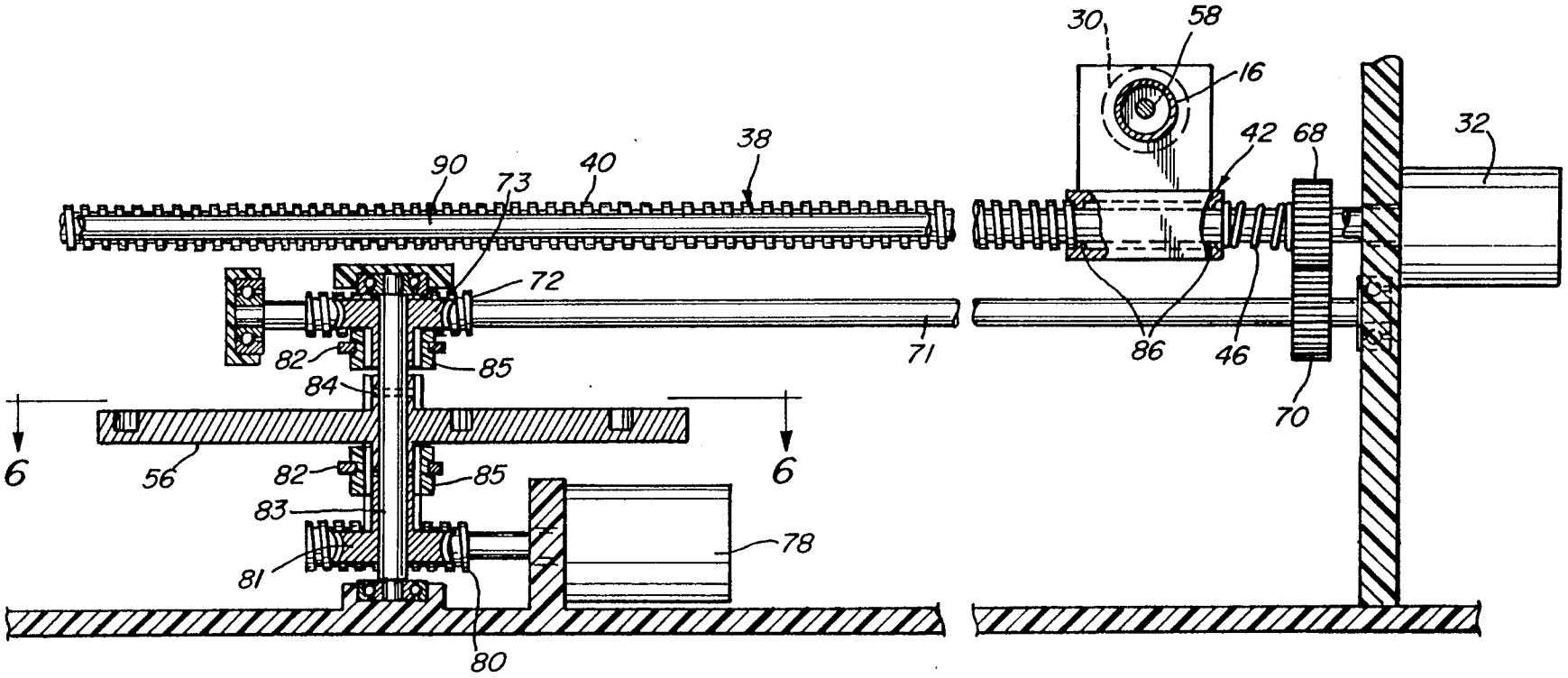
FIG. 4 is a cross sectional side view of the sport simulation game according to the present invention, taken along line 4—4 of FIG. 3.

Further details of this embodiment are illustrated in the cross-sectional view of FIG. 4. As illustrated, motor 78 controls worm drive 80 which engages worm gear 81. Cam 56 is attached to cam axle 83 with pin or set screw 84. Shifting fork 82 may connect either worm gear 81 to cam 56 or worm gear 73 to cam 56 through a splined slip coupling 85. As illustrated in FIG. 4, shifting fork 82 and slip coupling 85 connect worm gear 81 to cam 56. Thus, movement of playing field 20 is under manual control in this illustration. Slip coupling 85, controllable by shifting fork 82, is used to engage cam 56.

Also illustrated are circular gears 68 and 70 which rotate with the rotation of lengthwise rod 38. This rotation causes rotation of shaft 71, due to its attachment to circular gear 70, which in turn rotates gear 72. As lengthwise rod 38 is rotated thread followers 86 engage threads 40 and move member 42 lengthwise. This rotation is caused by motor 32. In addition, tube 16 is illustrated with threaded member 58 concentrically therein. Motor 30 (shown by a dashed line) causes rotation of threaded member 58.

Figure 5:
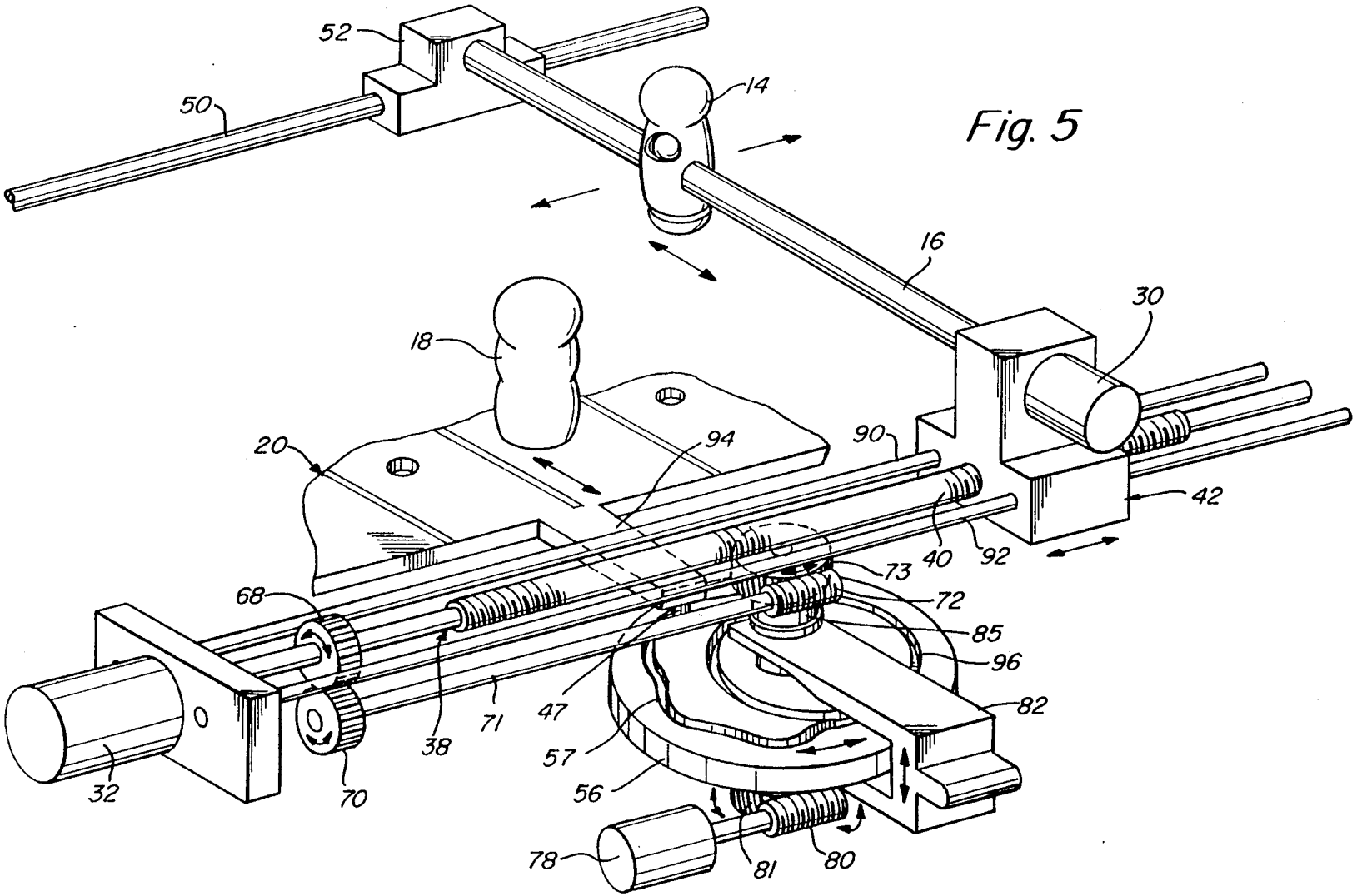
FIG. 5 is a diagramatic perspective view, illustrating the internal drive mechanisms of the sport simulation game according to the present invention.

FIG. 5 illustrates a complete view of the working mechanisms of game 10. As illustrated, offensive player 14 is attached to tube 16. It is to be appreciated that offensive player 14 moves widthwise back and forth along tube 16 as driven by motor 30. In addition, tube 16, with end members 42 and 52, moves lengthwise across the field. Member 52 rides along rod 50 lengthwise while member 42 rides along rod 38 with threads 40 thereon. Also illustrated are guide rods 90 and 92 which member 42 rides along. Motor 32 causes rotation of rod 38 which may drive cam member through circular gears 68 and 70, worm drive 72, and worm gear 73. Also shown is shifting fork 82 with associated slip coupling 85. In addition, motor 78 is illustrated for rotating worm drive 80 which rotates worm gear 81. Cam 56 is illustrated with groove 57 which is engaged by cam follower 47. Cam follower 74 is disposed on leg 94 of playing field 20. When cam 56 is rotated, cam follower 47 rides within groove 57 and playing field 20 is moved back and forth widthwise which cause movement of the defensive players 18 thereon.

Figure 6:
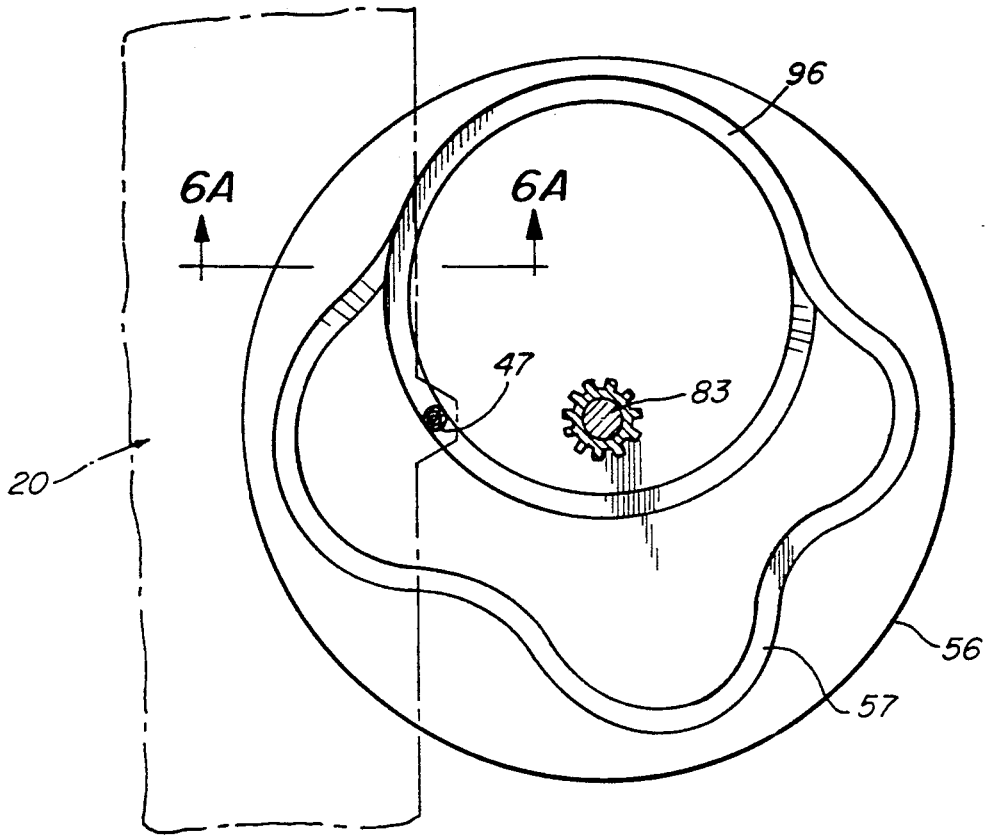
FIG. 6 is a cross-sectional plan view as taken along line 6—6 of FIG. 4 illustrating the cam according to the present invention.
Figure 6A:
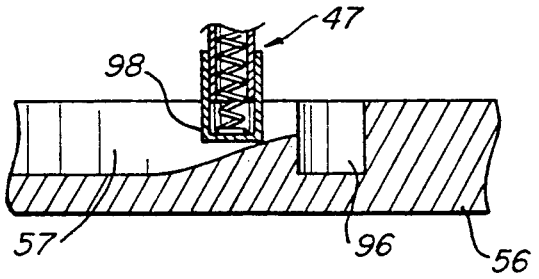
FIG. 6A is a partial cross-sectional side view of the cam according to the present invention, taken along line 6A—6A of FIG. 6 and showing an alternate tracking of the cam follower.

Further details of the cam are illustrated in FIGS. 6 and 6A. As illustrated in FIG. 6, cam 56 includes groove 57 and groove 96 with cam follower 47 engaged within groove 96. Clockwise rotation of cam 56 provides for controlled movement of playing field 20 with cam follower 47 in groove 96. Counterclockwise rotation of the cam provides erratic widthwise movement of playing field 20 and puts cam follower 47 into groove 57. It is to be appreciated that different grooves and cams could be used for different skill levels. In addition, the cams can be interchangeable, as will be described hereinafter in greater detail.

Referring to FIG. 6A, spring loaded cam follower 98 is illustrated in groove 57. With counterclockwise rotation, spring loaded cam follower 98 would ramp up and drop within other groove 96, effectively creating a one way tracking mechanism.

Figure 7:
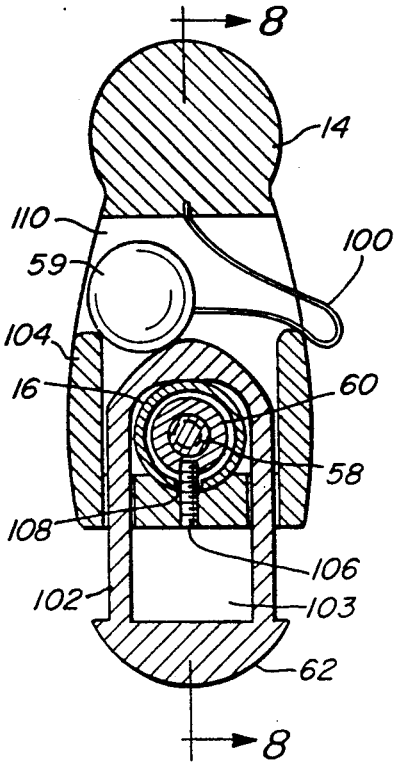
FIG. 7 is a cross-sectional side view taken along line 7—7 of FIG. 3 illustrating the offensive player according present invention.

Referring now to FIG. 7, offensive player 14 is illustrated in this cross sectional view. Player 14 includes housing 104 and slide member 102 within housing 104. Slide member 102 has downwardly depending member 62. Slide member 102 has a rectangular opening 103 which surrounds tube 16. Slide member 102 may slide between the position shown in FIG. 7 to an upward position. As illustrated, tube 16 surrounds threaded member 58. Thread follower 60 engages threaded member 58 and is held to housing 104 by screw 106. Screw 106 slides within slot 108 of tube 16. When a defensive player engages downwardly depending member 62 of slide member 102, slide member 102 is forced upwardly and engages ball 59 forcing the ball out of aperture 110.

String 100 is utilized to maintain attachment of the ball to member 14.

Figure 8:
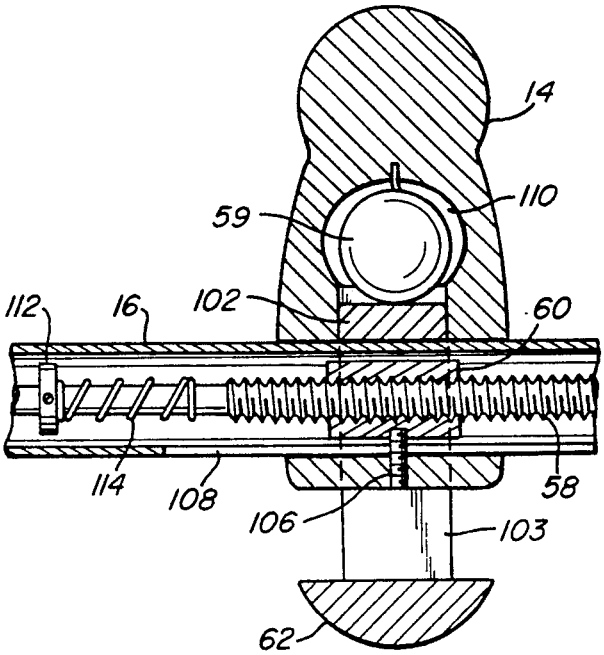
FIG. 8 is a cross-sectional front view of the offensive player according to the present invention, taken along line 8—8 of FIG. 7.

The cross-sectional side view of FIG. 8 illustrates tube 16 with threaded member 58 concentrically therein. Also illustrated is thread follower 60 disposed on threaded member 58 and set screw 106 which connects thread follower 60 to housing 104 of offensive player 14. Set screw 106 rests within slot 108 of tube 16. Return spring 114 exists against bushing 112 for engaging threaded member 60 and preventing any more widthwise movement of offensive player 14 when at this end position. Return spring 114 also provides for re-engagement of follower 60 with threads 58 when the direction of the threads 58 are reversed.

Figure 9:
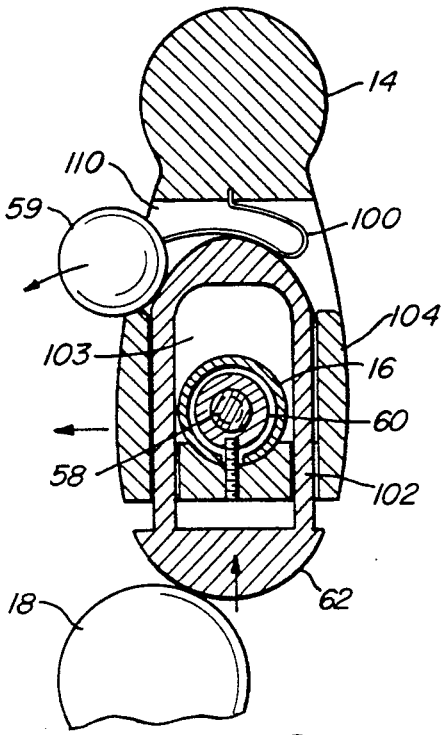
FIG. 9 is a cross-sectional view similar to FIG. 7 of the offensive player according to the present invention, while engaging a defensive player.

FIG. 9 illustrates the position of slide member 102 of offensive player 14 when in contact with a defensive player 18. Defensive player 18 contacts downwardly depending member 62 of slide member 102, forcing slide member 102 to rise upwardly within housing 104. Tube 16 is still within opening 103 of slide member 102. The top surface of slide member 102 engages ball 59 knocking ball 59 through aperture 110.

Referring now to FIG. 10, an alternate embodiment of the playing field 20' is illustrated. As illustrated, an array of three different shaped apertures exist on playing field 20'. A first row of round apertures 112, a second row of triangular apertures 113, and a third row of square apertures 116 all exist within the surface of playing field 20'. Defensive members 18' have downwardly depending pegs which rest within the apertures 112, 133, and 116. As shown, the defensive players 18' have round pegs 118, triangular pegs 120, and square pegs 122. It is to be appreciated that the game will only be provided with a certain number of defensive players with round pegs, triangular pegs, and square pegs. The number of defensive players provided with round pegs will be less than the number of round apertures in a row (the same applies for defensive players with square and triangular pegs). This is so such that a single row may not have each aperture filled with a defensive player.

Referring now to FIG. 11, a cross-sectional view of an interchangable alternate embodiment of the cam chamber illustrates the cams 56'. As illustrated, worm gear 81, is connected about axle bolt 124 to housing 126. Cam 56' rotates around centering post 74 and spring loaded cam follower 98 rests within the groove of cam 56'. The cams 56' is interchangeable. The cams 56' rests upon a lazy susan 130 which sits upon transport mechanism 132. Drawer 134 is designed to open up and create an opening within the housing. When drawer 134 is opened, the transport mechanism 132 drops down which disengages the interlocking spined hub 128 from with worm gear 81'. At this point, cam 56' can be slid out and replaced with another cam. Then drawer 134 is shut which causes transport mechanism to rise and spined hubs 128 of the replaced cam to engage worm gear 81'. If the spring loaded cam follower 98 does not initially rest within a groove of the replaced cam, rotation of the cam will soon place the cam follower 98 within a groove. It is to be appreciated, that with this alternate embodiment, only one worm gear 81' is utilized to engage cam 56'.

This embodiment is further illustrated in FIG. 12 where it is shown that worm drive 80' is utilized to drive worm gear 81'. Worm drive 80 is selectively coupled to motor 78' or the motor which drives the lengthwise movement of the offensive player. The selective coupling is accomplished through the circular gears by slip clutches 85' and shifting fork 82'. This is done by aligning the circular gear shaft 71' and shaft of motor 78' in a straight line and the using of sleeves within slip couplings 85'. The shifting fork is then moved upwardly or downwardly to engage the sleeves of slip couplings 85' to select the control of worm drive 80'. Alternatively, electric clutches could be used for this function instead of the shifting fork 82' and slip couplings 85'.

FIG. 13 illustrates an alternate embodiment of the cams. As illustrated, linear sliding cam 148 is engaged by cam follower 146 which is attached to the playing field 20. As illustrated, linear sliding cam 148 is provided with a peg 158 which is engaged by crank arm 156. Crank arm 156 is attached to crank 152 which is rotated either by the motor 32', which drives lengthwise movement of the offensive player, or by the motor 78'', which is controlled by the defensive hand control. Selecting the driving means of the crank 152 is performed by the electric clutches 140. It is to be appreciated that the linear sliding cam 148 has a ramped edge such that the playing field evenly moves widthwise back and forth as the crank rotates. Springs 142 urge the playing field, and thus the cam follower, against the linear sliding cam. Linear sliding cam 148 has a sliding track edge 150. It is to be appreciated that the sliding track edge 150 could be mounted on a drawer such that the cam could be replaced. An alternate linear cam 160, which could replace linear cam 148, is also illustrated.

Referring now to FIG. 14, linear cam 162 is shown with sliding track edge 150' mounted on a drawer for removal thereof. The drawer is illustrated with a handle 164 for removal. For removing the cam and replacing it, crank arm 156 would be lifted off peg 158 and the drawer would be slid out.

Referring now to FIG. 15, an alternate embodiment of the present invention is shown. This alternate embodiment includes a rotatable linear cam follower 168 with radial legs 170 and 172 for engagement with the tracks on cam 173 A control cable 166 is utilized to manipulate cam follower 168 between the two positions, and rotate cam follower 168 about the peg 169 such that either one of the radial legs 170 and 172 engage the erratic track or the controlled straight track on the cam 173. In this manner, movement of a playing field, and thus the defensive players, can be controlled.

Referring now to FIG. 16, a cross-sectional end view of an alternate embodiment of the working mechanisms of the present invention are illustrated. In particular, tube 16' is located underneath the playing field and offensive player 14' is located on the same surface as the defensive players, that being directly upon the playing field. As illustrated, thread follower 60' having an outer housing surrounding tube 16' engages the threaded member within rod 16 for widthwise movement thereon. Support tower 174 is attached to the housing of thread follower 60 and supports an upper magnet 176 thereon, which rests just below the playing field surface. The magnet 176 attracts steel mass 178, located within offensive player 14. In this manner, offensive player 14 is moved across the playing field.

Figure 16A:
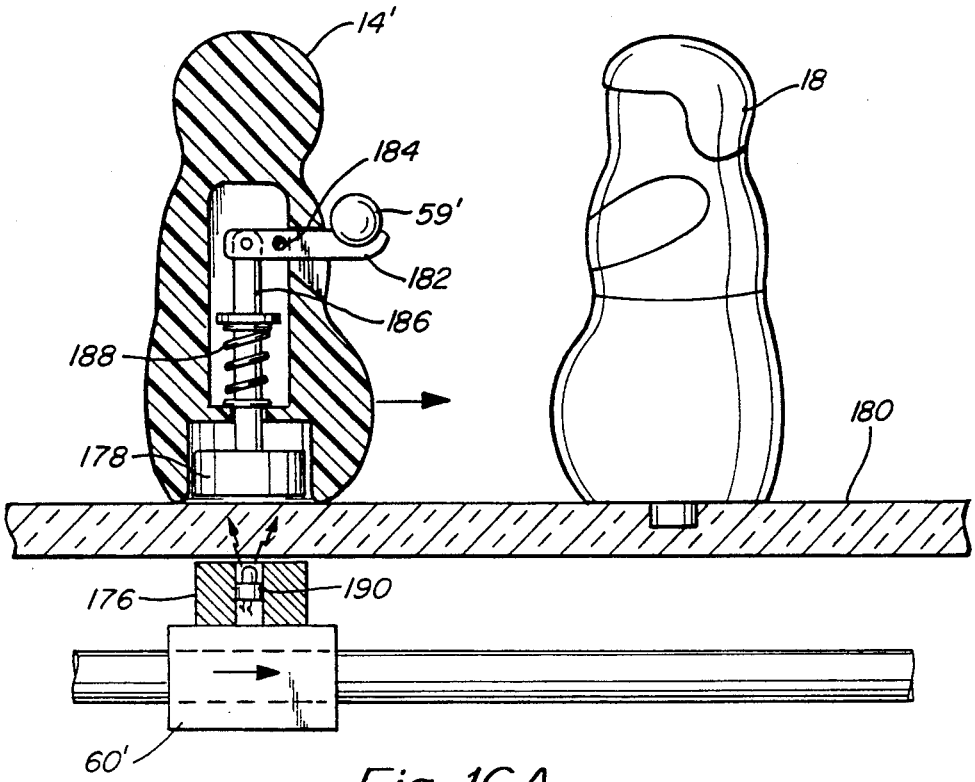
FIG. 16A is a cross sectional side view of the offensive and defensive players according to an alternate embodiment of the present invention.

FIG. 16A illustrates in greater detail the offensive player 14' and defensive player 18 according to this alternate magnetic drive mechanism of the present invention. Thread follower 60' with housing thereon is attached, through a support tower (not shown) to magnet 176. Within an opening in magnet 176 is LED 190. Magnet 176, through the playing field, attracts steel mass 178. Steel mass 178 is attached to a movable vertical member 186 which has a spring 188 thereon which urges member 186 upwardly. The magnetic attraction of steel mass 178 maintains member 186 against the force of spring 188. Also illustrated is arm 182 pivotally connected to member 186 in board of at pivot 184. Arm 182, while in the horizontal position, as illustrated, holds ball 59' against the force of gravity. This embodiment may include a green translucent playing field 180. LED 190 is hidden underneath the offensive player and steel mass 178.

When a defensive player contacts offensive player 14', as illustrated in FIG. 16B, thread follower 60' with a housing thereon continues to move while the offensive player 14' is prevented from further movement by the contact with defensive player 18. At this point, the spring 188 urges member 186 upwardly because the magnet 176 is beyond the range to attract steel mass 178. Member 186 pushes upon inboard end of the arm 182 causing the outboard end to fall downwardly as it rotates about pivot 184. At this point ball 59' falls from arm 182. In addition, LED 190 then shines through the playing field in order to aid the repositioning of the magnet 176 beneath the offensive player 14' for the next play.

Referring now to FIG. 17, a complete view of the drive mechanisms according to an alternate embodiment of the present invention are illustrated. As illustrated, hand cranks 194 and 196 are utilized to drive offensive player 208 lengthwise and widthwise across the playing field respectively. Hand crank 194 rotates lengthwise rode 38" with threads thereon causing lengthwise movement of member 204, which is attached to offensive player 208. Similarly, rotation of hand crank 196 causes rotation of threaded member 58' which causes widthwise movement of member 206, which is attached to offensive player 208. It is to be appreciated that this movement is the same as that described with respect to the first embodiment, except that the hand cranks 194 and 196 cause the rotation of the tubular members instead of a motor. In addition, like the first embodiment, movement of the defensive players 212 can be human controlled, or can occur automatically with the lengthwise movement of the offensive player 208. Set screw 218 is utilized to select between manual control and automatic movement of the defensive players 212. When the set screw is tightened for automatic movement of defensive players, bevel gears 202 and 200 are utilized to rotate rod 203. With the rotation of rod 203, bevel gears 230 cause rotation of hand wheel 234, which causes rotation of circular gears 228. With the rotation of circular gears 228, crank 224 is rotated. Crank 224 is connected to tray 214 through crank arm 226. Tray 214 has a pin through a slot 222 in the playing field which is connected to the crank arm 226. Tray 214 holds rotatable blocks 216 on which the defensive players 212 are located. Therefore, when hand crank 194 is rotated, crank 224 is rotated in the direction for forward motion of the offensive player, causing widthwise movement of the tray 214 which houses the defensive players 212. Note that tray 214 rests above the playing field as does offensive player 208 is suspended above the playing field. One way clutch 220 is set on rod 203 which provides for rotation of the distal end of rod 203 only upon movement of the offensive player 208 in one lengthwise direction. Therefore, one way clutch 220 can be set such that the defensive players 212 will only move when offensive player 208 is moved lengthwise in a direction toward defensive players and defensive players will not move with lengthwise movement of the offensive player in a direction away from the defensive players.

When set screw 218 is loosened for manual manipulation of the defensive players 212, a human player would manipulate hand wheel 234. This motion is translated through the circular gears 228 to the crank 224, which in turn manipulates tray 214 holding defensive players 212. It is to be appreciated that the hand wheel 234 can be rotated in both directions for widthwise movement of the defensive players 212 in both directions. Upon contact of the offensive player 208 with a defensive member 212, the offensive player rotates on a pivot in member 206, thus dropping the ball 59" from its curved recess on the outstretched horizontal portion of player 208.

Referring now to FIG. 18, a further alternate embodiment of the present invention is illustrated. As illustrated in FIG. 18, the game is a hockey game with housing 260. Playing field 236 includes holes 238, and moves widthwise in housing 260 by a mechanism similar to that of FIG. 17. Member 246 moves widthwise along tube 248 causing the offensive player 242 to move widthwise within housing 260. Rod 248 moves lengthwise within housing 260. An offensive player 242 carrying a puck 240 on the playing field 236 would move lengthwise across the playing field as it is moved back and forth widthwise while attempting to avoid the holes 238 and place the puck within goal 250. The puck 242 is smaller than the holes 238 such that the puck would fall within one of the holes if the offensive player cannot avoid these holes. The offensive player would have widthwise and lengthwise controllable movement in any direction for avoiding these holes. The control and movement of the offensive player would be the same as that described above with the other embodiments.

While the sport simulation game of the present invention has been described with reference to a football and an alternate embodiment hockey game, it is to be appreciated that it is envisioned that this game could encompass other sports such as, but not limited to, soccer, rugby, lacrosse, field hockey, skiing, auto racing, and track.

Having now described a limited number of embodiments of the invention, it should now be apparent to those skilled in the art that numerous other embodiments and modifications thereof are contemplated as falling within the scope of the present invention as defined by the appended claims.

What is claimed is:

1. A human controlled sport simulation game comprising:

a two dimensional playing field having a length and a width;

an offensive player operable and controllable to move lengthwise and widthwise over said playing field;

an array of defensive players, attached to said playing field, operable to move at least widthwise, wherein a person controlling movement of said offensive player attempts to move said offensive player fully along the playing field lengthwise while avoiding engagement with any of the defensive players;

an electric hand control means for controlling movement of said offensive player;

means, responsive to said electric hand control means, for moving said offensive player lengthwise;

means, responsive to said electric hand control means, for moving said offensive player widthwise;

means for moving said array of defensive players widthwise;

an electric hand control means for controlling movement of said array of defensive players;

wherein said offensive player further includes a means for carrying a ball; and a means for disengaging the ball from said offensive player when said means comes in contact with a defensive player.

2. A human controlled sport simulation game comprising:

a two dimensional playing field having a length and a width;

an offensive player operable and controllable to move lengthwise and widthwise over said playing field said offensive player including a means to carry a ball;

an array of defensive players, attached to said playing field, operable to move at least widthwise, wherein a person controlling movement of said offensive player attempts to move said offensive player fully along the playing field lengthwise while avoiding engagement with any of the defensive players;

a hand control means for controlling movement of said offensive player;

means, responsive to said hand control means, for moving said offensive player lengthwise including a lengthwise rotatable rod having threads thereon and a member surrounding said rod and operably connected to said offensive player, said member having a thread follower for engaging said threads, such that said member moves lengthwise when said lengthwise rod rotates;

means, responsive to said hand control means, for moving said offensive player widthwise;

a second hand control means for controlling movement of said array of defensive players;

means, responsive to said second and control, for moving said array of defensive players; and a means for disengaging a ball from said offensive player when said offensive player comes in contact with the defensive player.

3. The human controlled sport simulation game of claim 2, wherein said means for moving said offensive player lengthwise further includes a first motor, controlled by said offensive player hand control, for rotating said lengthwise rod.

4. The human controlled sport simulation game of claim 3, wherein said means for moving said offensive player widthwise includes a widthwise rotatable rod having threads thereon and a thread follower, surrounding said rod for engaging said threads and connected to said offensive player, such that said offensive player moves widthwise when said widthwise rod rotates.

5. The human controlled sport simulation game of claim 4, wherein said means for moving said offensive player widthwise further includes a second motor, controlled by said offensive player hand control, for rotating said widthwise rod.

6. The human controlled sport simulation game of claim 5, wherein said means for moving said array of defensive players widthwise includes a rotatable cam having a groove therein and a cam follower engaging said grove, said cam follower connected to said playing field, such that said cam follower moves widthwise when said cam is rotated.

7. The human controlled sport simulation game of claim 6, wherein said means for moving said array of defensive players widthwise further includes a third motor, controlled by said defensive players hand control, for rotating said cam.

8. The human controlled sport simulation game of claim 7, wherein said means for moving said array of defensive players further includes a set of self-engaged rotatable gears, operably connected to said lengthwise rod, and a worm drive, said worm drive operably connected to said cam, such that rotation of said lengthwise rod causes rotation of said rotatable gears, said worm drive and said cam.

9. A human controlled sport simulation game comprising:

a two dimensional playing field having a length and a width, said playing field operable and controllable to move widthwise, said playing field having an array of apertures therein for receiving defensive players;

an offensive player operable and controllable to move lengthwise and widthwise over said playing field and carrying a disengagable ball, said ball being disengaged when said offensive player contacts one of said defensive players;

a first hand control for controlling movement of said offensive player;

a second hand control for controlling movement of said array of defensive players;

a lengthwise rotatable rod having threads thereon and a first thread follower surrounding said lengthwise rod, and operably connected to said offensive player, for causing lengthwise movement of said offensive player;

a widthwise rotatable rod having threads thereon and a second thread follower surrounding said widthwise rod, and operably connected to said offensive player, for causing widthwise movement of said offensive player; and a rotatable cam with a groove thereon and cam follower within said groove, said cam follower operably connected to said playing field for causing widthwise movement of said array of defensive players.

10. A human controlled sport simulation game comprising:

a two dimensional playing surface having a length and a width, and having obstacle means thereon, said playing surface movable at least widthwise;

a controllable player, operable to move lengthwise and widthwise over said playing surface, wherein a person controlling movement of said player attempts to move said player lengthwise over said playing surface while avoiding said obstacle means;

hand control means for controlling movement of said player;

hand control means for moving said playing surface widthwise a lengthwise rotatable rod having threads thereon and a first thread follower surrounding said lengthwise rotatable rod, and operably connected to said player, for causing lengthwise movement of said player;

a widthwise rotatable rod having threads thereon and a second thread follower surrounding said widthwise rod, and operably connected to said player, for causing widthwise movement of said player; and a rotatable cam having a groove thereon and a cam follower within said groove, said cam follower operably connected to said playing surface for causing widthwise movement of said playing surface.

11. The human controlled sport simulation game of claim 10 wherein said multiple obstacle means includes an array of defensive players, attached to said surface, and said player includes a football player object which carries a disengagable ball, said ball disengages when said football player object comes into contact with a defensive player.

* * * * *